US005687437A

United States Patent [19]

Goldsmith

[11] Patent Number: 5,687,437

[45] Date of Patent: Nov. 18, 1997

[54] MODULAR HIGH-LOW ADJUSTABLE BED BASES RETROFITTED WITHIN THE VOLUMES OF, AND COOPERATIVELY OPERATIVE WITH, DIVERSE EXISTING CONTOUR-ADJUSTABLE BEDS SO AS TO CREATE HIGH-LOW ADJUSTABLE CONTOUR-ADJUSTABLE BEDS

[76] Inventor: Aaron Goldsmith, 3250 E. 19th St., Long Beach, Calif. 90804

[21] Appl. No.: 600,759

[22] Filed: Feb. 13, 1996

Related U.S. Application Data

[63] Continuation-in-part of Ser. No. 435,799, May 3, 1995, which is a continuation-in-part of Ser. No. 193,796, Feb. 8, 1994, Pat. No. 5,490,298.

[51] Int. Cl.[6] ..... A61G 7/00

[52] U.S. Cl. ..... 5/611; 5/620; 5/613

[58] Field of Search ..... 5/11, 611, 613, 5/620, 659, 660, 509.1

[56] References Cited

U.S. PATENT DOCUMENTS

| | | | |
|---|---|---|---|
| 2,523,076 | 9/1950 | Sweetland | 5/611 |
| 2,681,454 | 6/1954 | Tallman | 5/611 |
| 3,191,195 | 6/1965 | Schlackman et al. | 5/611 |
| 4,381,571 | 5/1983 | Elliott | 5/620 X |
| 4,654,903 | 4/1987 | Chubb et al. | 5/509.1 X |
| 5,095,560 | 3/1992 | Volker | 5/611 X |
| 5,490,298 | 2/1996 | Goldsmith et al. | 5/611 |

*Primary Examiner*—Michael F. Trettel
*Attorney, Agent, or Firm*—William C. Fuess

[57] ABSTRACT

Various high-low bases including (i) a frame, and (ii) various lift mechanisms for supporting and for variably elevating the frame above a floor, fit completely under, and within the pedestal base, of a conventional contour bed. In one embodiment a motorized hydraulic drive mechanism variably controllably elevates the entire contour bed, including its pedestal base, in height above the floor, thereby to order to facilitate transfer of a user of the bed to and from a wheelchair, or the provision of care to the user who lies supine upon the bed. In another embodiment the lift mechanism is a motorized screw drive acting through cables to control lifting lever arms. In still another embodiment the screw drive of the lifting lever arms is direct. An upper surface of the contour bed is mechanically adjustable to contour a mattress that rests upon this upper surface independently of the hydraulic adjustment of the height of the bed. Various combinations of height-and-contour-adjustable, height-adjustable, contour-adjustable, and non-adjustable bed units may be harmoniously aesthetically and functionally combined, particularly for use in the home.

26 Claims, 6 Drawing Sheets

FIG. 3
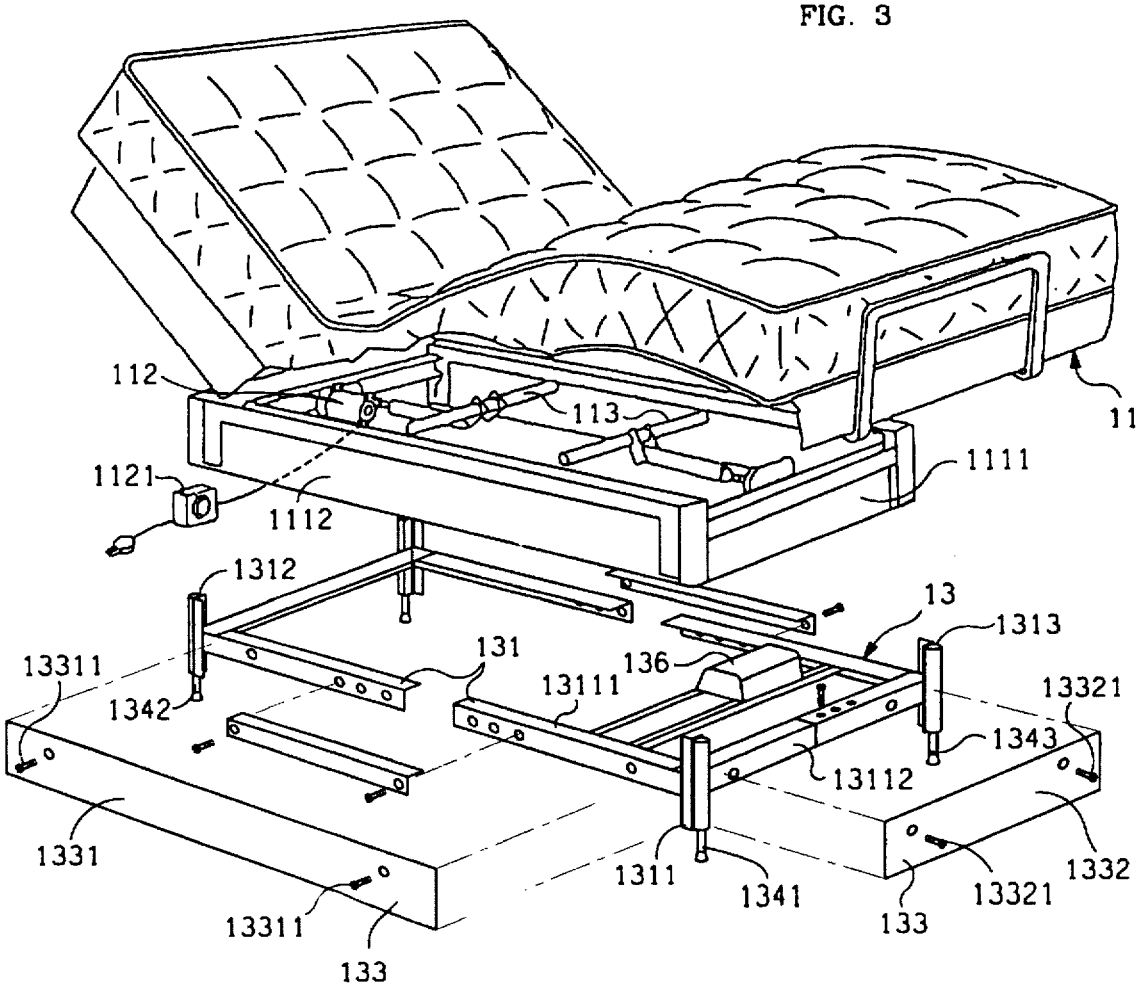
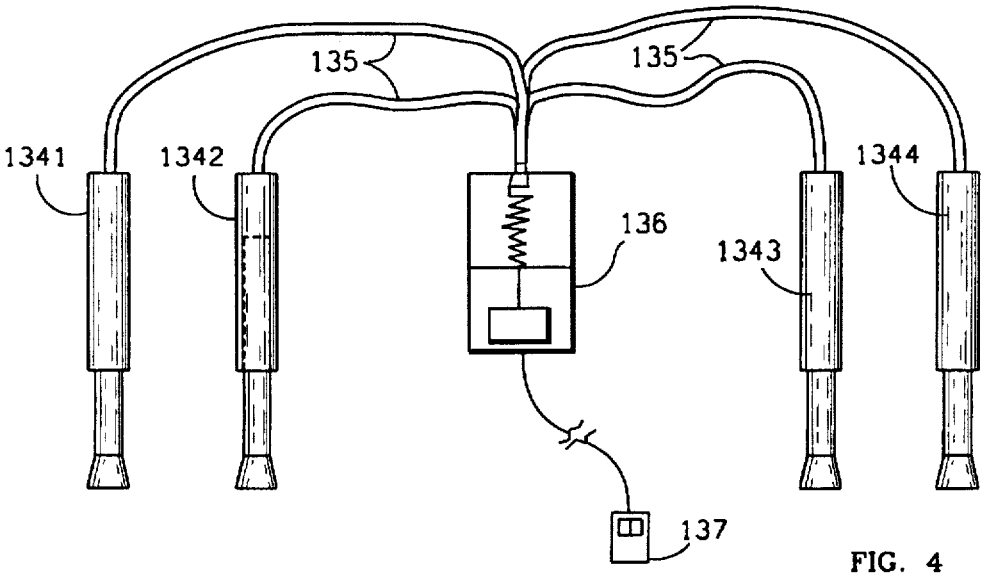
FIG. 4

FIG. 6
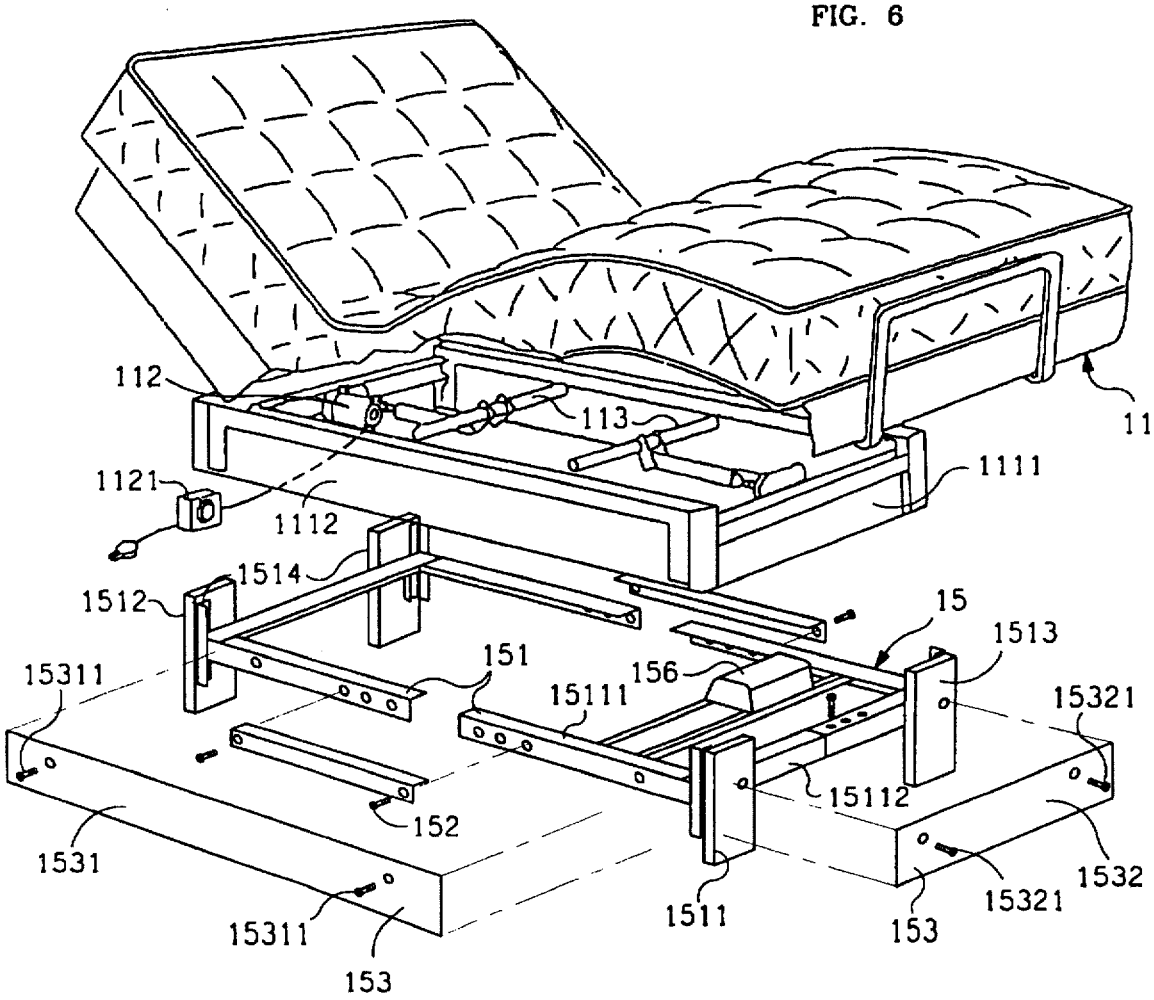
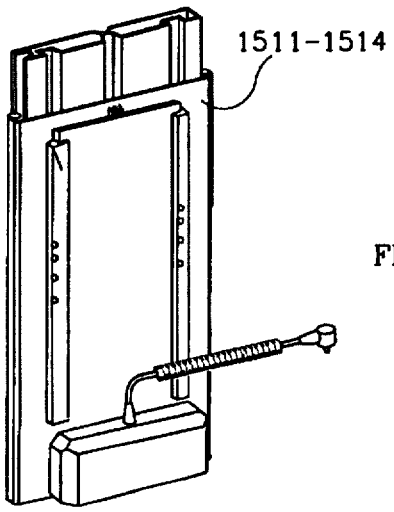
FIG. 7

MODULAR HIGH-LOW ADJUSTABLE BED BASES RETROFITTED WITHIN THE VOLUMES OF, AND COOPERATIVELY OPERATIVE WITH, DIVERSE EXISTING CONTOUR-ADJUSTABLE BEDS SO AS TO CREATE HIGH-LOW ADJUSTABLE CONTOUR-ADJUSTABLE BEDS

RELATION TO THE RELATED PATENT APPLICATIONS

The present patent application is a continuation-in-part of U.S. patent application Ser. No. 08/435,799 filed on May 3, 1995, for a SIZE-ADJUSTABLE, HYDRAULIC HIGH-LOW-ADJUSTABLE, MODULAR BED BASE, PARTICULARLY TO SHIELD AND TO MOUNT A CONTOUR-ADJUSTABLE BED to the same Aaron Goldsmith who is the sole inventor of the present application. That application is itself a continuation-in-part of U.S. patent application Ser. No. 08/193,796 filed on Feb. 8, 1994, for a MODULAR HIGH-LOW-ADJUSTABLE CONTOUR-ADJUSTABLE BED issued Feb. 13, 1996, as U.S. Pat. No. 5,490,298, to inventors including the same Aaron Goldsmith who is the sole inventor of the present application. The contents of both related, predecessor, patent applications are incorporated herein by reference.

BACKGROUND OF THE INVENTION

1. Field of the Invention

The present invention generally concerns adjustable beds. The present invention particularly Concerns beds that are (i) modular in construction, (ii) adjustable in height above the floor (i.e., high-low adjustable), and (iii) adjustable in the contours of a mattress that is supported upon the bed (i.e., contour-adjustable).

The present invention still further particularly concerns a high-low bases to contour beds which bases are (i) tailored in size and volume to fit within (or substantially completely within) the volumes of diverse existing contour beds, and (ii) variably extendible in elevation, so as (iii) to mount and to carry, and also (iv) to shield the sides (and all mechanisms), of the contour-adjustable bed.

2. Description of the Prior Art

The present invention will be seen to concern modular beds that are adjustable in (i) height above the floor as well as in (ii) the contours of a that is mattress supported upon the bed. The present invention will be further seen to concern modular high-low base units that cooperatively fit to and engage each existing contour beds that the topmost sleeping surface of the contour bed may be variably raised above a floor surface as well as being adjusted in contour. Power mechanisms of the high-low base units will be seen to compactly share the volume under the existing contour bed while being shielded from external view.

2.1 Hospital Beds

A true hospital bed is typically adjustable in both (i) height and (ii) contour. However, a hospital bed is typically an integral unit, i.e., non-modular, and is normally of considerable size and weight. The considerable size and weight of a hospital bed is fully satisfactory for hospital purposes, and, indeed, contributes to the durability and stability of the bed. A hospital bed is normally only but infrequently moved, and then solely within the confines of a hospital. The normal use of the bed requires bringing a patient, on a wheelchair or gurney if necessary, to the bed. When a hospital bed is moved then it is normally transported by rolling on strong casters over non-resilient hard floors, and by freight elevator between the floors of a multi-story building.

A hospital bed is also very distinctive in appearance, and considerably different from conventional household beds and bedroom furnishings. The frame of a hospital bed is typically made entirely of metal which is often polished or painted. The metal frame of the bed is typically only but minimally shielded from view, and then typically only by panels and side-boards of man-made material typically having a hard, smooth and durable surface. The aesthetic appearance of a hospital bed is secondary to its required functionality, including a required easy access to its frame in order that it may be cleaned and sanitized as necessary.

Because of all these characteristics a hospital bed is normally sufficiently visually distinctive so that it may be unambiguously and easily identified to so be a hospital bed even should it appear in incongruous circumstances such as, for example, in a home bedroom.

2.2 Contour Beds

Meanwhile, a type of bed having some, or all, of the capabilities of a hospital bed to adjust the contours of a mattress—but lacking the capability of a hospital bed to raise and lower the mattress in height above the floor—is called a contour bed. In the advanced industrial countries including the U.S.A. contour beds are, circa 1996, routinely sold for home use.

Contour beds use normal household sheets, blankets and other bedding. They are, in accordance with their intended environment of use, quite normally appearing relative to non-contour household beds. They may, for example, have platform bases that are surfaced in wood, vinyl padding, or other materials suitably incorporated in the decor of a home bedroom.

Contour beds may have double, or split, mattresses with each side of the bed being independently adjustable under separate control of the occupant of that side. Sometimes one contour bed, typically of twin size, is placed side-by-side with an identically externally-appearing bed that, while having a same or similar mattress, rests upon a base that is without the capability of contour adjustment. In this manner a sole occupant, or a couple only one of whom desires contour adjustment, may save the cost of having the entire surface of the bed to be adjustable while preserving the form factor of a double twin, or king size, bed.

2.3 Requirements for Certain Features of a Hospital Bed in Combination with Certain Features of a Contour Bed It is desirable to combine the capability of a hospital bed to be adjustable in height above the floor with the suitable appearance of a contour bed for location in the bedroom of a private home. The capability of the contour bed to adjust the contours of a mattress that it supports must be preserved.

The fundamental reasons why it is useful to have a bed that is adjustable in height in a home setting are the same as it is in a hospital setting: to facilitate (i) transfers into the bed, (ii) transfers out of the bed, and/or (iii) the rendering of care by a person standing or sitting alongside the bed to a person, normally supine, located on the bed.

An individual may most easily transfer from a wheel chair to a bed, and vice versa—whether with assistance or unassisted—when the bed surface is twenty inches (20") in height, or less, above the floor upon which both the bed and the wheelchair rest. Transfers into the bed from a wheelchair are normally conducted level, or sometimes with the bed slightly lower in order that gravity may assist the transfer. Likewise, an individual normally transfers most easily from a bed to a wheel chair—whether with assistance or unassisted—when the bed surface is at approximately the same height as the wheelchair seat above the floor upon which both the bed and the wheelchair rest. Transfers from the bed into a wheelchair are normally conducted with the bed slightly higher in order that gravity may assist the transfer. The rendering of care to a person located on the bed is normally conducted when the bed surface is elevated considerably higher, typically thirty-two inches (32") high or higher, than is the same surface during occupant transfers. An individual within the bed is normally accorded discretionary control of the bed's height for purposes of better and more satisfactory interaction with the environment from the viewing of television and window scenes to the conduct of reading or conversation.

Some existing contour beds will, if not elevated on pedestals and when their mattress contours are set level, have a total height of 20" or less, and thus be roughly suitable for transfers to and from wheelchairs. Unfortunately, while a hospital bed will raise its occupant to the height convenient to any of (i) a caretaker, (ii) bedside furniture, (iii) bedside conversation, and/or (iv) the viewing of television after being entered by the occupant at a low height, a contour bed set low upon the floor has no such capability.

Moreover, there are special reasons, not present in a hospital, why within a home setting (i) a contour bed should be adjustable in height, or, alternatively and conversely, (ii) a height-adjustable bed should also be adjustable in contour. These reasons have to do with (i) interaction between a couple sharing a bed, and (ii) aesthetics of the bed during its occupancy by two, one or zero persons.

When one, physically-impaired, member of a couple sharing a bed has a requirement for access to the bed at some non-standard height (which height may be abnormally low or high) above the floor, there are good reasons why this portion of the bed should be adjustable in both height and contour. Adjustment in height is clearly desirable not only so that a portion of the bed that is so adjustable may be conveniently entered (or exited), but also so that this portion may be brought level with the remaining, height-unadjustable, portion of the bed for reasons of improved affinity, including conjugal relations, between occupants of the bed. It is extremely awkward and undesirable that one bed portion should be permanently superior or inferior in elevation to the other bed portion.

It is somewhat more subtle, but also true, that the portion of a home bed that is adjustable in height should also be adjustable in contour. It is desirable that a height-adjustable bed portion should also be contour-adjustable for the same reasons that couples often order dual-adjustable contour beds—both desire to individually and collectively enjoy the comforts of an adjustable mattress.

A dual-occupant, double size or larger, home bed is normally unoccupied by at least one occupant, and typically by both occupants, for substantial portions of the day. The unoccupied entirety, or part, of the bed may be made up, and covered by a bedspread, during this period for optimal aesthetic appearance. It is typically desirable, if only from the point of view of a sole occupant, that the unoccupied side portion of a double bed should not look incongruous all day long, such as by towering above or hovering below the occupied side portion. It is likewise desirable that, when the bed is vacated, both side portions should be made to be as visually identically appearing as is possible. These requirements are obviously satisfied when the portion of the bed that is adjustable in height and in contour is so adjustable to assume the height, and the contour, of the remaining, height-unadjustable, portion.

One, brute-force, solution to realizing the full (i) height and (ii) contour adjustment capabilities of a hospital bed in a home environment would be to adopt a hospital bed, as best as was possible, to the aesthetic, space and weight requirements of a home. Perhaps a hospital bed having no capability of adjustment in height, but preserving its capability to adjust the contour of the mattress, could be produced at reduced cost as a type of contour bed. Generally, however, a hospital bed is a large, integrated and very expensive structure that is neither well, nor easily, adapted to the home.

The present invention will be seen to take an alternative approach, and to attempt to enlarge the capabilities of existing contour bed—which contour beds are well-accepted in home use and which capabilities are well-proven—to encompass the height adjustability of a hospital bed while fully preserving the (i) aesthetics, (ii) substantial economies, and (iii) proven performance of the contour bed.

2.4 Requirements to Retrofit Existing Contour Beds

As previously stated, in the advanced industrial countries including the U.S.A. diverse models of contour beds from many different manufacturers are, circa 1996, routinely sold for home use. The various models may vary in the particular orthopedic support provided, in size, in type and in power of the contour-adjustment mechanism, in cost, and in many other factors.

These existing contour beds are, however, almost universally possessed of a rectangular box frame open to the bottom. Within the volume enclosed by the frame only a portion is devoted to the motive means, and the mechanism, for contour adjustment. The reasons why this is true are simple. The frames of existing contour beds are predominantly rectangular not only because that is the prevailing shape of beds and mattresses, but because those particular mattresses that are suitably adjusted in contour are normally rectangular, and the shape of the bed frame matches the work piece mattress. Existing contour beds are normally open to the bottom because they tend to be quite heavy already and sufficiently strong without a bottom panel, because no one sees the underside of the contour bed, and because it is not desired to retain dust and other items both microscopic and macroscopic falling from the surface of the bed within the confines of the bed's frame. For those rave contour beds possessing a bottom panel, the panel is normally readily removable. Finally, (i) the contouring mechanism is located at the underside of the mattress, near the top of the frame which, at normal above-floor bed height, is much thicker, while (ii) the motive power, which is normally an electric motor, typically occupies but a small fraction of the remaining volume.

Existing contour beds once built are often desirably selectively combined with a high low base both (i) at the time of initial sale, and before initial delivery and deployment, or (ii) afterwards, as a retrofit. Not all persons who purchase a contour bed may then want a high-low mechanism, and it is generally inefficient for the retailer to stock high-low beds that are identical save for either possessing or lacking a high-low lift capability. Additionally, people already possessing satisfactory contour beds may come with increasing age and infirmity to additionally desire a high-low lift capability for their existing contour beds.

Nonetheless to being usefully combined with a high-low base, and seemingly having some potential of so being combined, existing contour beds from various manufacturers present a bewildering array of mechanisms and layouts. It is therefor necessary, and useful, that any scheme for interactively, cooperatively, employing a high-low base in combination with an existing-type contour bed should be flexible, and should be clever in serving to mate a separate high-low bed lift capability and mechanism to various existing contour bed capabilities and mechanisms. The fitting, and the mating, of a separate high-low base mechanism to various existing contour beds is a subject of the present invention.

SUMMARY OF THE INVENTION

The present invention contemplates modular high-low bases that are retroffitable to and within the volumes of, and that are cooperatively operative with, diverse existing contour-adjustable beds so as to make high-low-adjustable contour-adjustable beds. The composite high-low-adjustable contour-adjustable beds so made include (i) a high-low base portion that is adjustable in height above a floor, and, resting upon this high-low base portion, (ii) a contour bed portion that is suitable to adjust the contours of a mattress that it supports. Both bed portions are normally shipped, sold and delivered separately, and may be readily separated from each other.

An existing contour bed with which a high-low base of the present invention is used typically includes a (i) contour-adjustable upper surface upon which is supported a mattress, (ii) a box frame, (iii) a contouring mechanism, and (iv) a contour mechanism motive means for powering the contouring mechanism to adjust the upper surface in contour. The box frame is open to the bottom; the box frame and the upper surface and the floor in combination define a volume. Notably, the contouring mechanism, and also the contour mechanism motive means, are located within but a fractional portion of this volume. The remainder of the volume is a void.

In accordance with the present invention, a selectively attachable high-low base is positioned under, and is cooperatively interactive with, this existing contour bed.

The preferred high-low base includes a high-low frame that is smaller than, equal to, or insubstantially larger in area than is the area of the box frame of the contour bed. The box frame of the contour bed suitably rests on this high-low frame so that the entire contour bed is carried thereby.

Meanwhile an elevation mechanism for the high-low frame—suitable to variably elevate in height above the floor a portion of the high-low frame and the contour bed resting upon this frame portion—fits entirely within the void.

Herein lies a notable advantage of the present invention. Because the high-low frame is, at worse, only insubstantially larger in area that is the box frame of the contour bed, and because the elevation means fits within the void, the entire high-low base is, at worse, only insubstantially larger in area upon the floor than is the box frame of the contour bed, and the entire contour bed, that it serves to variably elevate. This means that a high-low lift capability may be added to an existing contour bed (i) without modification of the contour bed, and (ii) without increasing the form factor of the contour bed in either area upon the floor or, when fully lowered, volume. The high-low frame is effectively "hidden" by the existing contour bed.

In detail, the high-low frame typically includes (i) a lower frame member that is supported upon the floor and (ii) an upper frame member on which suitably fits and rests the box frame of the contour bed. An elevation mechanism serves to variably elevate the upper frame member in height above the lower frame member and above the floor upon which the lower frame member is supported.

This elevation mechanism may consist of, for example and as a first embodiment, a motorized drive mechanism connecting between the lower frame member and the upper frame member in the volume between them. Additionally, optionally, an idler arm may serve to maintain the lower frame member and the upper frame member in positional alignment.

The elevation mechanism may consist of, for example and as a second embodiment, a typically two (2) or four (4), vertically-oriented cylinders that are affixed between the high-low frame and floor. A selectively activated hydraulic system forcibly extends and retracts this plurality of hydraulic cylinders so that the high-frame, and the contour bed that is carried upon high-low frame, is raised and lowered in elevation above the floor.

Four hydraulic cylinders may be used in this second embodiment, in which case the high-low frame typically includes a hollow corner post at of the four corners of a rectangle. One of the four hydraulic cylinders is positioned in each of these corner posts. If, alternatively, only two hydraulic cylinders are used, then these are commonly positioned centrally at the foot, and at head, of the bed.

Two frame rails extends at a right angles relative to each other from each corner post so as to each mechanically joint to a correspondingly-extending frame rail of and from an adjacent corner post. A mechanism serves to variably adjust the mechanical joining of the frame rails of the corner posts so as to circumscribe a variable rectangular area in which suitably fits and rests a rectangular contour bed of variably predetermined size. This mechanism is normally a simple strut bridging between an extending frame rail of a one corner post and the correspondingly-extending frame rail of an adjacent corner post so that the length of the frame rails necessary to circumscribe the rectangular area of variable size may be lessened to the extent of the contribution of the length of the strut.

Each of the vertically-oriented hydraulic cylinders commonly has its plunger disposed in a downwards direction so as to contact the floor at its tip region. Meanwhile, the selectively activated hydraulic system typically includes (i) a rotary hydraulic pump acting to provide hydraulic force to the plurality of hydraulic cylinders for their selective extension and retraction, (ii) an electric motor for rotating the hydraulic pump, and (iii) an electrical control panel for selectively applying electric power to the electric motor under manual control.

The elevation mechanism may further consist of, for example and as yet another, third, embodiment, a number of linkage arms pivoting relative to each of an upper member and a lower member of the high-low frame, and connecting therebetween so as to, upon forcibly assuming different positions, locate the upper member and the lower member different distances of separation one to the other. A cable transmits force to these linkage arms. Finally, a motor provides the force that is transmitted through the cables to the linkage arms. The motor, cable and linkage arm mechanism serves, by locating the upper member and the lower member to different distances of separation one to the other, to raise and lower the contour-adjustable bed. An idler arm for maintaining the lower member and the upper member in positional alignment is optionally further included.

This third embodiment is still consonant with the principles of the invention: each every one of the (i) lower and upper members of the high-low frame, and (ii) the elevation mechanism, fit entirely within the volume and within the area of the box frame of the contour-adjustable bed.

The elevation mechanism may still further consist of, for example and as yet another, fourth, embodiment, a number of elongate extension members. Somewhat similarly to the hydraulic cylinders, these elongate extension members connect between lower, and upper, portions of the high-low frame. As usual, the elongate extension members connect within, or substantially within, the volume, and in, or substantially in, the area, between the lower and portions of the high-low frame. The elongate extension members variably controllably extend in length so as to locate the upper portion of the high-low frame at different distances of separation from the lower portion of the same high-low frame—thereby raising and lowering the contour-adjustable bed having the box frame that rests upon the upper portion of the high-low frame.

This fourth embodiment is still yet again consonant with the principles of the invention. Because the upper portions of the high-low frame insubstantially increase the volume and the area of the box frame, because the lower portions of this same high-low frame are substantially in the shadow of the box frame, and because the elongate extension members connect between the lower portions and the upper portions of the high-low frame, the entire high-low base is insubstantially larger in area than is the contour-adjustable bed that it serves to lift.

The extension members typically are typically either four or two in number, as are respectively located at either the four corners, or else at the head and at the foot, of the high-low frame and of the contour bed that is carried upon the high-low frame. The extension members are typically electrically-actuated screw drive mechanisms, or power rams.

In still other details of its construction, the high-low frame preferably simply supports, and does not mechanically affix, the box frame of the contour bed.

The high-low frame is normally, and preferably, adjustable in height independently that the contour-adjustable upper surface of the contour bed is adjustable in contour.

The supported and elevated contour bed may, in particular, have and mount a surround skirt having horizontal dimensions sufficient so as to fit circumferentially about the high-low frame, and having a vertical dimension sufficient so as to essentially bridge a vertical gap between the contour-adjustable upper surface of the contour bed and the floor when the high-low frame is in a full down position. In this case the surround skirt clearly serves to fully surround the high-low base, and to enclose it from view, when the high-low base is in its full down position.

These and other aspects and attributes of the present invention will become increasingly clear upon reference to the following drawings and accompanying specification.

BRIEF DESCRIPTION OF THE DRAWINGS

FIG. 3 is an exploded diagrammatic perspective view showing another, second, preferred embodiment of a modular high-low-adjustable base in accordance with the present invention in use supporting the same contour-adjustable bed that was previously seen in FIG. 1; this second embodiment of the high-low base being raised and lowered by hydraulic force.

FIG. 4 is a diagrammatic view of the hydraulic system of the second preferred embodiment of the modular high-low-base of the present invention previously seen in FIG. 3.

FIG. 6 is an exploded diagrammatic perspective view showing still yet another, fourth, preferred embodiment of a modular high-low-adjustable base in accordance with the present invention in use supporting the same contour-adjustable bed that was previously seen in FIG. 1; this fourth embodiment of the high-low base being raised and lowered by four extension members.

FIG. 7 is a diagrammatic view of an extension member of the fourth preferred embodiment of the modular high-low-base of the present invention previously seen in FIG. 6.

DESCRIPTION OF THE PREFERRED EMBODIMENT

Figure 1:
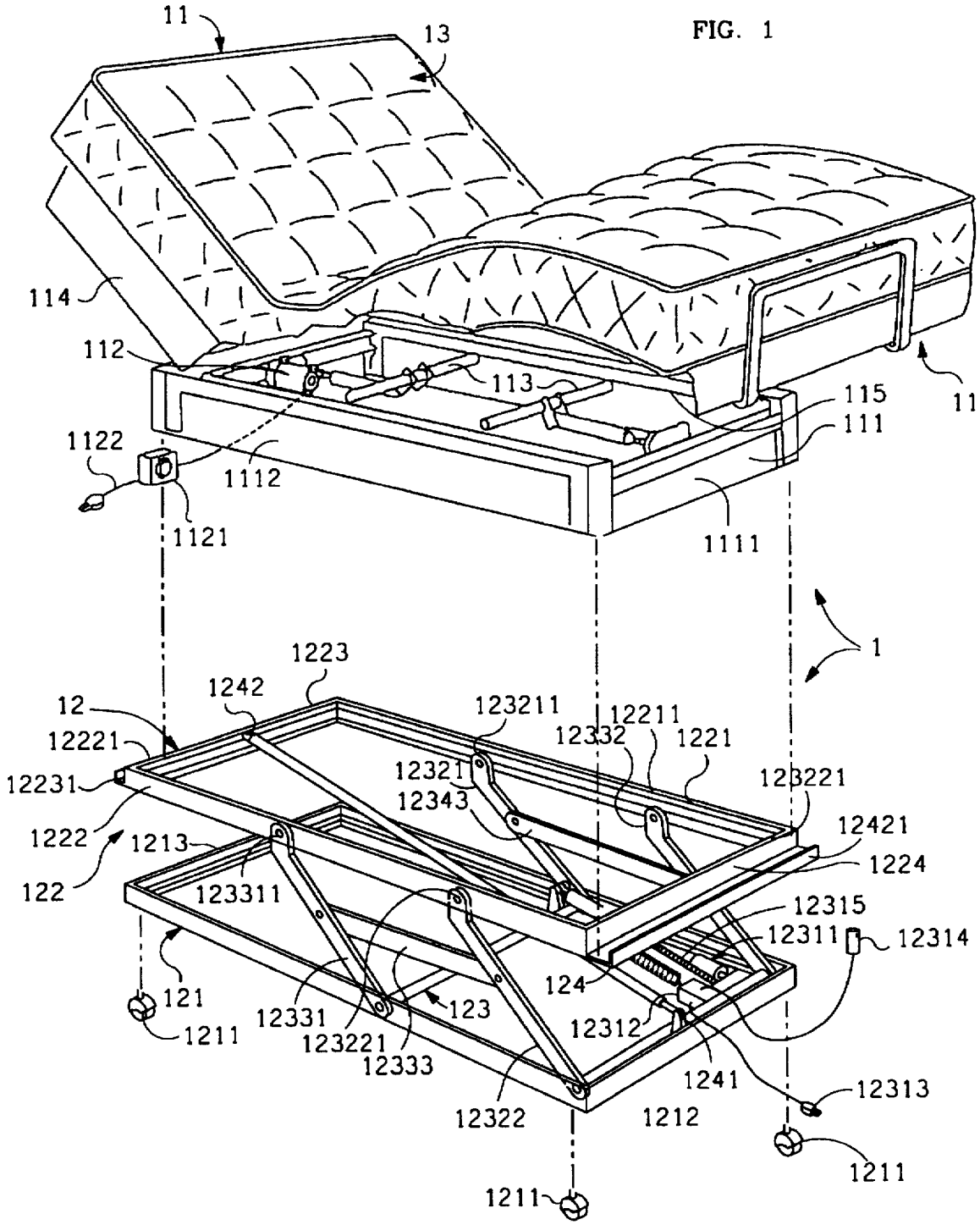
FIG. 1 is an exploded diagrammatic perspective view showing a first embodiment of a modular high-low-adjustable base of the present invention, which base is usable with a contour-adjustable bed to a high-low-adjustable contour-adjustable bed including an uppermost contour bed and a lowermost high-low base.

An exploded diagrammatic perspective view of a first preferred embodiment of a modular high-low-adjustable base 12 for a contour-adjustable bed 11 in accordance with the present invention is shown in FIG. 1. The modular high-low-adjustable base 12 and the contour-adjustable bed 11 comprise in combination a high-low-adjustable contour-adjustable bed 1.

The contour bed 11 is of various standard constructions. A typical contour bed 11 includes a perimeter frame 111 within which is located one or more motors 112 electrically connected to a control panel 1121 and then, by a power cord 1122, to a source of (typically) a.c. power. The motor 112 operates to move the lever arms of rotating elements 113 so as to selectively displace the upper portion mattress support member 114 and the lower portion mattress support member 115 to various angles and elevations. These various angles impart a contour to a detachable mattress 13 that is positioned atop the support members 114, 115.

In accordance with the present invention, the high-low base 12 is added by retrofit as a new assembly to an existing contour bed 11, or is furnished along with a new contour bed 11, in order to realize a complete modular high-low-adjustable contour-adjustable bed 1.

The illustrated first embodiment of the high-low base 12 includes a rectangular lower frame member 121, an rectangular upper frame member 122, and a motorized elevation assembly 123 for variably elevating the upper frame member 122 in height above the lower frame 121. An idler arm 124—rotationally connected to the lower frame member 121 by the hinge joint 1241, and to the upper frame member 122 by hinge joint 1242—serves to maintain the lower frame member 121 and the upper frame member 122 in positional alignment.

The lower frame member 121 rests upon a floor (not shown), either directly or upon typically on four castors 1211 that are disposed at the underside of the four corners of the rectangular lower frame member 121. The rectangular lower frame member 121 has and two relatively shorter, foot and head, end sides 1212, 1213.

The rectangular upper frame member 122 has and presents to its exterior at each of its two relatively shorter, foot and head, end sides 1223, 1224 a typically continuous, typically full-length, shelf 12231, 12241. The shelves 12231, 12241 form a shallow "U" channel with an upward-directed opening to the "U". The purpose of the shelves 12131 and 12141 is to engage the corresponding sides 1111, 1112 of the platform-base frame 111 to the contour bed 1.

The upper frame member 122 has and defines two (2) typically (but not necessarily) continuous, typically (but not necessarily) full-length, channels, or tracks, 12211, 12221 at the interior of its two long sides 1221 and 1222. Each channel, or track, 12211 and 12221 serves to engage, and to restrain for rolling motion, a corresponding pair of the roller assemblies 123211, 123221 and 123311, 123321 of the arms 12321, 12322 and 12331, 12332, Both the lower frame member 121 and the upper frame member 122 are commonly made from steel angle iron, typically 12 gauge alloy steel.

The motorized elevation assembly 123 is in the form of a motorized drive mechanism connecting between the lower frame member 121 and the upper frame member 122, and is located in the volume between these frame members 121, 122. The motorized elevation assembly 123 serves to variably controllably elevate the upper frame member 122 in height above the lower frame member 121.

Figure 2:
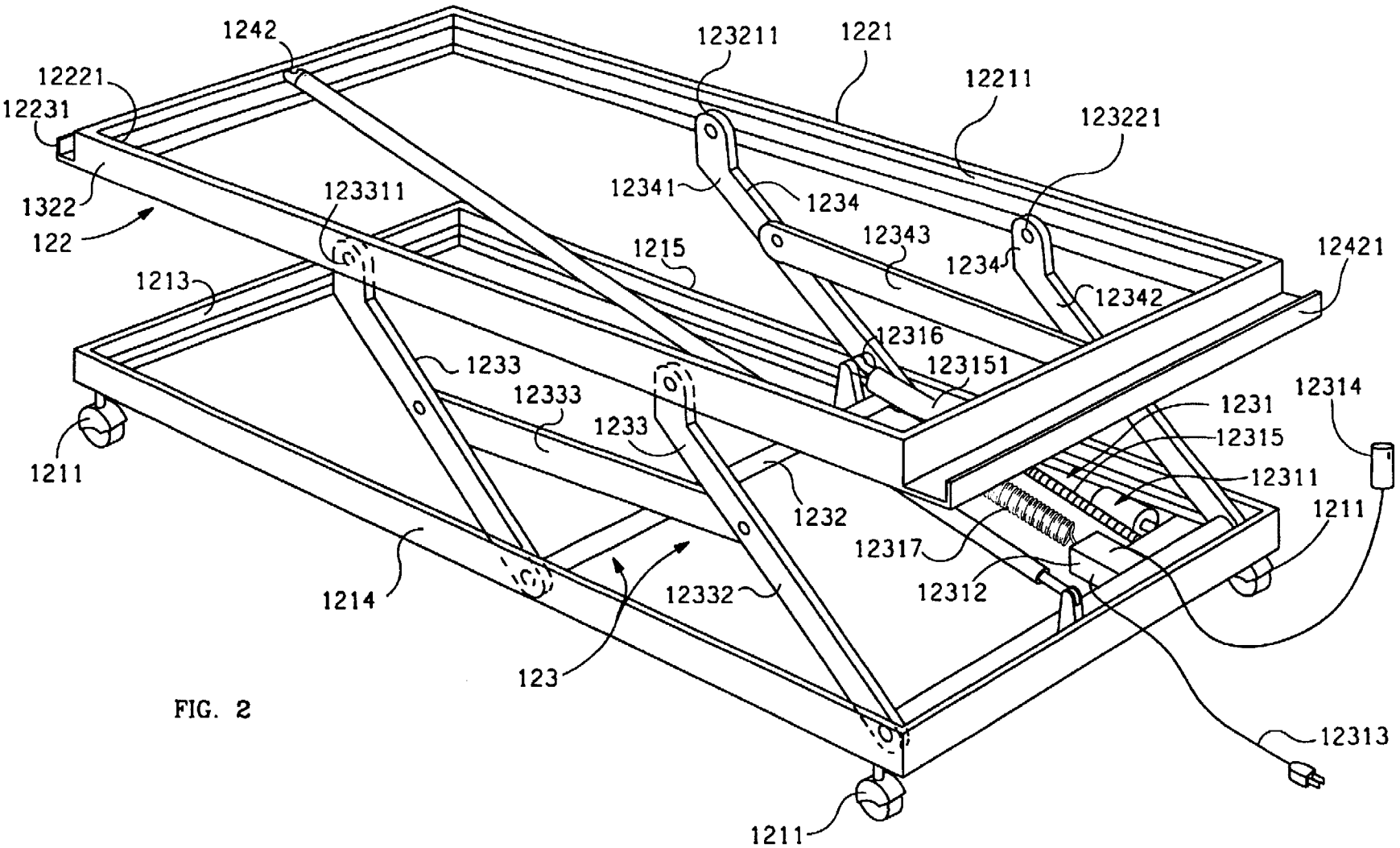
FIG. 2 is a detail view of the first embodiment of the high-low base previously seen in FIG. 1, the view particularly showing the preferred motor, screw and screw and screw follower assembly that adjusts the height of the modular high-low-adjustable base, and of the contour-adjustable bed resting upon such base, in accordance with the present invention.

As is best seen in FIG. 2, the motorized elevation assembly 123 includes an electrical motor drive assembly 1231 that itself includes, as electrical components, a bi-directional electric motor 12311, an electrical junction box 12312, a power cord 12313 and a hand-held control 12314. The hand-held control 12314 serves under the momentary manual switch activation by a user (not shown) of the contour bed to gate electrical power from a wall outlet (not shown) to which power cord 12312 is connected, through the electrical junction box 12312, and to the electric motor 12311, causing the electric motor 12311 to turn the screw 12315 in a selected rotational direction.

The screw 12315 that is affixed at its one end to the motor 12311 threads at its other end a screw follower 123151. The screw follower 123151 is at one end of a lever arm 12316 that is affixed at its other end to a shaft 1232. Rotation of the screw 12315 by the motor 12311 causes the screw 12315, the screw follower 123151, and the lever arm 12316 affixed thereto to forcibly rotate the shaft 1232. Rotation of the shaft 1232 in opposite directions raises and lowers the upper frame 122, and the contour bed 11 (shown in FIG. 1) that rests thereon.

The function of the motor 12311 and its associated drive components to rotate the shaft 1232 so that the upper frame 122, and the contour bed 11 (shown in FIG. 1), become raised in elevation is aided by a strong spring 12317 that is attached between a short end 1211 of the lower frame 121 and, preferably, the same end of the lever arm 12316 to which the screw follower is attached. The spring 12317 is normally in extension, and serves to pull against the end of the lever arm 12316.

In certain variants and versions of the high-low base 12, of the high-low-adjustable contour-adjustable bed 1 of which the base 12 is a part, the extension, and force, of the spring 12317 may be adjustably preset by a simple take-up mechanism (not shown). In this manner the force exerted by the motor 12311 both to raise, and to lower, the upper frame 122 and the contour bed 11 may be roughly balanced in anticipation of the weight of both (i) the actual contour bed 11 in use, and, optionally additionally, (ii) the rough expected weight of the occupant of the contour bed 11. The spring 12317 will thus be recognized as a common mechanism by which the strain on, and necessary forces exerted by, the motor 12311 may be reduced, and may optimally be minimized.

Meanwhile, the motorized elevation assembly 123 further includes arm pairs 1233 and 1234, each respectively consisting of two arms 12331, 12332 and 12341, 12342. The arm pairs 1233 and 1234 are opposed upon opposite long sides 1214, 1215 of the rectangularly-shaped lower frame member 121, and also upon opposite long sides 1222, 1221 of the rectangularly-shaped upper frame member 122. Each of the arms 12331, 12332 and 12341, 12342 of the respective arm pairs 1233 and 1234 is respectively rotationally affixed to the long sides 1214, 1215 of lower frame member 121, normally by a pin or bearing (not shown), or by such other means as are common for the creation of hinge joints. Each of the arms 12331, 12332 and 12341, 12342 of the respective arm pairs 1233 and 1234 is respectively affixed for rotating and sliding relative to the channels 12211, 12221 of the long sides 1221, 1222 of upper frame member 122, normally by sliding wheel bearing (not shown), or by such other means as are common for the creation of low-friction sliding joints.

An optional linkage 12333 connects the arms 12331, 12332 of the arm pair 1233, and an optional linkage 12343 connects the arms 12341, 12342 of the arm pair 1234 in order to impart extra stability and strength. The shaft 1232 is immovably affixed to the ends of one arm of each of the opposed arm pairs 1233, 1234, namely to arms 12331 and 12341, at the points of the rotatable affixation of these arms 12331, 12341 to the long sides 1214, 1215 of the lower frame member 121.

By these fixed, rotating and sliding connections, rotation of the screw 12315 by the motor 12311 causes the screw follower 123151 and the lever arm 12316 affixed thereto to forcibly rotate the shaft 1232, turning the arms 12331, 12341 connected to the shaft 1232 and changing the angle thereof relative to each of the lower frame member 121 and the upper frame member 122. As this angle changes the lower frame member 121 and the upper frame member 122 are forced to a variable degree of separation one from the other.

The motorized elevation assembly 123 includes as it largest non-peripherally-located components the motor 12311, the shaft 1232, and the idler arm 124. These components may suitably occupy complementary voids in the parallelepiped volume enclosed by the frame 111 of the contour bed 11. The frame 111 is substantially in the shape of the four-sided, topless and bottomless, rectangular box. As is illustrated, a portion of the volume enclosed by this frame 111 is void, or empty. The motor 12311 and the remaining associated elements of the motorized elevation assembly fit within this void when the high-low base 12 is fully retracted.

Yet another, second, embodiment of a modular high-low-adjustable contour-adjustable bed in accordance with the present invention is shown in exploded diagrammatic perspective view in FIG. 3. The uppermost position is occupied by the same contour bed 11 previously seen in FIG. 1. A lowermost position is occupied by a second embodiment of a high-low base. This second embodiment of a high-low base 13 is characterized by being (i) adjustable in size to fit and to carry a bed of any normal size, including a contour bed 11 of any normal size, and (ii) raised and lowered by hydraulic force. This second, embodiment of a high-low base 13—particularly for use with a pre-existing bed and more particularly for use with the same contour bed 11 previously seen in FIG. 1—is both (i) adjustably preset in size during installation, and (ii) variably adjustable in height during usage.

The high-low base 13 continues to be in the shape of a rectangular parallelepiped body that is defined by a box frame 131 substantially laving four detachable side walls or side panels 133—of which the side panels 1331 and 1332 are illustrated—so as to substantially present the shape of an open-bottomed and an open-topped rectangular box. The box frame 131 includes four corner pieces 1311–1313 (corner piece 1314 is obscured) each of which preferably has and presents two frame rails, such as the identified frame rails 13111 and 13112 of corner piece 1311, that are preferably permanently configured and affixed to each other, preferably by welding, at a right angle. The shorter of the frame rails, for example the frame rail 13112, overlaps to a variably predetermined extent its counterpart frame rail of the adjacent corner piece (i.e., corner piece 1313), therein to variably preset the width of the box frame 131 to the (contour) bed 11 that it serves to carry during the process of installation.

Such adjustable overlap of bed rails is common. Less common is the manner of the adjustable preset of the longer of the frame rails, for example the frame rail 13111. In this case a bridging rail, or strut, 13113, is preferred in order to permit mechanical connection with the counterpart frame rail of the next corner piece (i.e., corner piece 1312). The bridging rail, or strut, 13113, permits the longer frame rails of each corner piece 1311–1314 to be shipped and transported at the same length as the shorter frame rail of each such corner piece, thereby saving on shipping volume. All the mechanically connecting frame rails of the corner pieces 1311–1314 are preferably secured one to the next, and at an essentially infinitely variable degree of separation within gross limits, by nuts and bolts 132 that are threaded through pre-existing holes.

Side walls, or side panels 131 (of which side panels 131 only side panels 1331 and 1332 are illustrated, the remaining two side panels being obscured) are respectively fitted to each pair of jointed corner posts 1311–1314 (corner post 1314 is obscured). The side panels are typically made from plastic, wood, or like materials. They may be telescoping in length so as to adjust to the separation of the joined corner posts 1311–1314, but are preferably simply cut to any desired length upon installation of the bed. The side panels 131 are preferably affixed to the rails of the joined corner posts by nuts and bolts, of which bolts 13311 of side panel 1331 and bolts 13321 of side panel 1332 are exemplary.

The side panels 131 completely surround both the high-low base 13 and any bed—which may optionally be a contour bed 11—that is carried upon the high-low base 13. Regardless of whether the high-low base 13 is in a lowered or a raised position (as will be discussed), its side panels 131 substantially visually obscure the underside of the carried contour bed 11 including, for example and in particular, the sides 1111 and 1112, the motor 112, and the rotating elements 113 of the carried contour bed 11.

Further in the construction of the high-low base 13, one of the hydraulic cylinders 1341–1344 (cylinder 1344 is obscured) is fitted vertically within each corner post 1311–1314 (corner post 1414 is obscured). The plungers of the hydraulic cylinders 1341–1344 are preferably disposed in a downwards direction. All hydraulic cylinders 1341–1344 are flow-connected by hydraulic lines 135 to a combination hydraulic pump and electric motor assembly 136. The combination hydraulic pump and electric motor assembly 136 is controlled to run in a selected direction, selectively raising and lowering the hydraulic cylinders 1341–1344 in common, and also the corner pieces 1311–1314 and the (contour) bed 11 that rests upon these corner pieces, under human activation of hand control 137. (This hand control 137 is separate and distinct from the control panel 1121 of the contour bed 11—although both controls may be brought out to the user at a common area.)

A diagrammatic view of the hydraulic system of the second embodiment of the modular high-low-adjustable contour-adjustable bed in accordance with the present invention is shown in FIG. 4. The preferred combination hydraulic pump and electric motor assembly 136 is a lift system type 4-PB6-B6-300-MA available complete as a package called the "MOVOTEC® lift system" from Suspa, Inc., 3070 Roger Chaffe Street, Southeast, Grand Rapids, Mich. 49548-3497 U.S.A. (MOVOTEC® is a registered trademark of Suspa, Inc.). The adjustment (lift) range of the preferred system is 300 millimeters (30 centimeters). The lift capacity of the four hydraulic cylinders 1341–1344, collectively, is one thousand pounds (1000 lbs.). Additional hydraulic cylinders may employed for even greater lift capacity on special order, and configuration, of the high-low base 13. A fold-away hand crank for activation of the hydraulic pump in the absence of electric poser to the motor is supplied as part of the "MOVOTEC® lift system". This hand crank is conceivably useful in installations of the high-low base 11 at sites not having electric power, or suffering a temporary absence of electric power.

Returning to FIG. 3, the entire combination hydraulic pump and electric motor assembly 136 again, and notably, fits—as did the motorized elevation assembly 123 of the first embodiment of the high-low base 12 seen in FIGS. 1 and 2—completely within a void in the volume under the contour bed 11.

Figure 5:
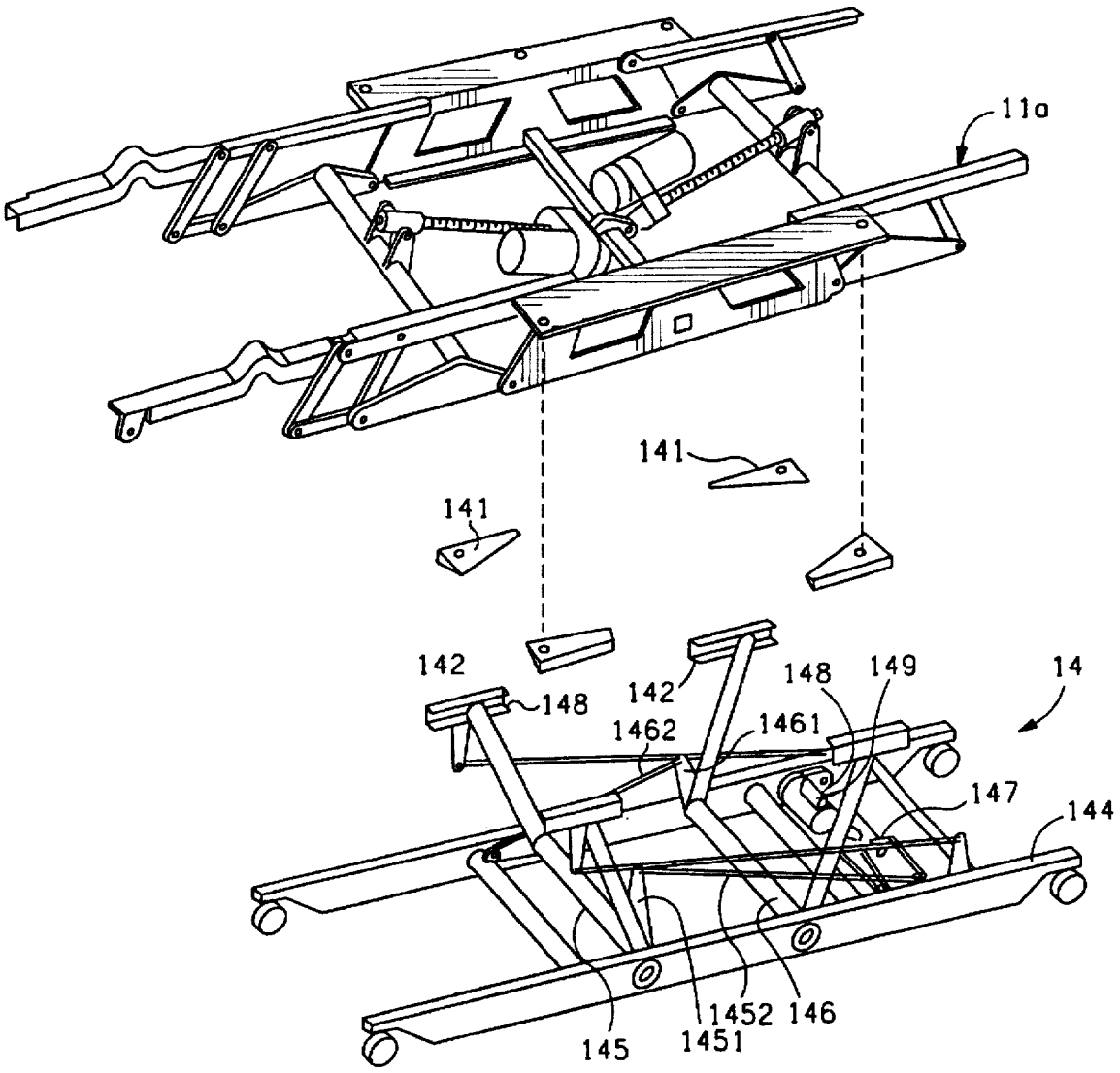
FIG. 5 is an exploded diagrammatic perspective view showing yet another, third, preferred embodiment of a modular high-low-adjustable base in accordance with the present invention in use supporting a new embodiment of a contour-adjustable bed; this third embodiment of the high-low base is raised and lowered by a mechanism including cables.

Still yet another, third, embodiment of a modular high-low-adjustable base for a contour-adjustable bed in accordance with the present invention is shown in exploded diagrammatic perspective view in FIG. 5. The illustrated new embodiment of the supported contour bed 11*a* is, in particular, the ADJUSTABLE ARTICULATED BED that is taught in U.S. Pat. No. 4,381,571 issued May 3, 1983 to Elliott. The content of that patent is incorporated herein by reference. The illustrated patented contour bed is still, circa 1996, made by assignee of the patent Maxwell Products, Inc., Cerritos, Calif., U.S.A.—a major U.S. manufacturer.

The third embodiment of a high-low base 14 is characterized by being raised and lowered on lever arms by a force that is exerted thought cables that are connected to a screw follower that travels on a screw that is turned by a motor. As illustrated, the Maxwell contour bed has and offers four points of attachment at its lower extremities which points are admirably connected to, and engaged, by the four mating pieces 141. The four mating pieces 141 in turn fit over, and engage the four top plates 142 of the four lever arms 143. This same mating pieces 141 also permit attachment to contour beds available from Leggett & Platt, Inc.—another major U.S. manufacturer.

A two of the four lever arms 143 that are disposed to a one end of the frame 144 are fixed mounted to a first rotatable shaft 145. The remaining two of the four lever arms 143 that are disposed to the opposite end of the frame 144 are fixed mounted to a second rotatable shaft 146. A first idler arm 1451 is affixed to, and extends from, shaft 145 while a second idler arm 1461 is affixed to, and extends from, shaft 146.

Each of the idler arms 1451, 1461 affixes at its end a respective cable 1452, 1462. A one end of each of the cables 1452, 1462 is affixed to a screw follower 147 on screw 148 that is selectively alternately turned in each of both rotational directions by the motor 149. The path of the cable 1452 is the more straightforward, and may be observed to make only one turn at and through a suitable pulley of the like before connecting, and transmitting force from, the screw follower 147 to the idler arm 1451 of shaft 145. The path of the cable 1462 is slightly more obscured in FIG. 5. After leaving the screw follower 147 and proceeding to an opposed interior wall of the frame 144, the cable 1462 is doubled back in direction through a suitable pulley or the like. Proceeding to an opposite interior wall of the frame 144, it then passes through yet another pulley or the like before connecting, and transmitting force, to the idler arm 1461 of shaft 146 from the screw follower 147.

In operation of third embodiment of a high-low base 14 shown in FIG. 5, the motor 149 is controlled to turn in a particular direction, correspondingly rotating the screw 148 and causing the screw follower 147 to proceed or retract along the screw 148. The force of the screw follower 147 is transmitted through the cables 1452, 1462 and the idler arms 13451, 1461 to shafts 145, 1456 so as to cause these shafts 145, 146 to rotate in concert, and to correspondingly move the lever arms 143 in concert. The movement of the lever arms 143 raises and lowers the four top plates 142, and correspondingly raises and lowers the contour-adjustable bed (not shown in FIG. 5, shown in FIGS. 1 and 3) that rests upon these top plates 142.

Notably in FIG. 5, the high-low base 14 continues to be in the shape of a rectangular parallelepiped body. Side panels (not shown, similar to side panels 131 shown in FIG. 3) may be employed to completely surround both the high-low base 14 and any bed—which may optionally be a contour bed 11—that is carried upon the high-low base 14. Regardless of whether the high-low base 14 is in a lowered or a raised position such optional side panels will substantially visually obscure the underside of the carried contour bed.

Still yet another, fourth, embodiment of a modular high-low-adjustable base for a contour-adjustable bed in accordance with the present invention is shown in exploded diagrammatic perspective view in FIG. 6. The supported contour bed 11 is the same as was previously seen in FIGS. 1 and 3. This particular contour bed is available from the aforementioned Leggett & Platt, Inc. This fourth embodiment of a high-low base 15 is characterized by being raised and lowered an extension mechanisms, or power rams, 152, These power rams, of which a detail perspective view is shown in FIG. 7, are preferably of type the type called "MULTILIFT" available from Dewert, U.S.A. The MULTILIFT™ rams ("MULTILIFT" is a trademark of Dewert) are installable and usable in any position, including the illustrated vertical position. The can be universally controlled with any one of several controllers called "Duomat", "Dymat", "Multimat" and "Megamat" by manufacturer Dewert. The rams are suggested by their manufacturer to be useful in lifting "care beds" (as well diverse other items), but the rams are conceived and shown to be permanently attached to the (contour) bed frame that they serve to raise, and are not suggested to be part of a separate, retrofittable, high-low base.

Continuing in FIG. 6, the uppermost position is occupied by the same contour bed 11 previously seen in FIG. 1. A lowermost position is occupied by the fourth embodiment of a high-low base 15. This fourth embodiment of a high-low base 14 is characterized—as was the second embodiment of the high-low base 13 shown in FIG. 3—by being (i) adjustable in size to fit and to carry a bed of any normal size, including a contour bed 11 of any normal size, and (ii) raised and lowered by force. This fourth, embodiment of a high-low base 15—particularly for use with a pre-existing bed and more particularly for use with the same contour bed 11 previously seen in FIG. 1—is again both (i) adjustably preset in size during installation, and (ii) variably adjustable in height during usage.

The fourth embodiment of the high-low base 15 continues to be in the shape of a rectangular parallelepiped body that is defined by a box frame 151 substantially having four detachable side walls or side panels 153—of which the side panels 1531 and 1532 are illustrated—so as to substantially present the shape of an open-bottomed and an open-topped rectangular box. The box frame 151 includes four corner pieces 1511–1513 (corner piece 1514 is obscured) each of which preferably has and presents two frame rails, such as the identified frame rails 15111 and 15112 of corner piece 1511, that are preferably permanently configured and affixed to each other, preferably by welding, at a right angle. The shorter of the frame rails, for example the frame rail 15112, overlaps to a variably predetermined extent its counterpart frame rail of the adjacent corner piece (i.e., corner piece 1513), therein to variably preset the width of the box frame 151 to the (contour) bed 11 that it serves to carry during the process of installation.

Such adjustable overlap of bed rails is common. Less common is the manner of the adjustable preset of the longer of the frame rails, for example the frame rail 15111. In this case a bridging rail, or strut, 15113, is preferred in order to permit mechanical connection with the counterpart frame rail of the next corner piece (i.e., corner piece 1512). The bridging rail, or strut, 15113, permits the longer frame rails of each corner piece 1511–1514 to be shipped and transported at the same length as the shorter frame rail of each such corner piece, thereby saving on shipping volume. All the mechanically connecting frame rails of the corner pieces 1511–1514 are preferably secured one to the next, and at an essentially infinitely variable degree of separation within gross limits, by nuts and bolts 152 that are threaded through pre-existing holes.

Side walls, or side panels 151 (of which side panels 151 only side panels 1531 and 1532 are illustrated, the remaining two side panels being obscured) are respectively fitted to each pair of jointed corner posts 1511–1514. The side panels are typically made from plastic, wood, or like materials. They may be telescoping in length so as to adjust to the separation of the joined corner posts 1511–1514, but are preferably simply cut to any desired length upon installation of the bed. The side panels 151 are preferably affixed to the rails of the joined corner posts by nuts and bolts, of which bolts 15311 of side panel 1531 and bolts 15321 of side panel 1532 are exemplary.

The side panels 151 completely surround both the high-low base 15 and any bed—which may optionally be a contour bed 11—that is carried upon the high-low base 15. Regardless of whether the high-low base 15 is in a lowered or a raised position, its side panels 151 substantially visually obscure the underside of the carried contour bed 11 including, for example and in particular, the sides 1111 and 1112, the motor 112, and the rotating elements 113 of a carried contour bed 11.

Further in the construction of the high-low base 15, an extension mechanism, or power ram, 1541–1544 is fitted vertically at each corner. The power rams 1541–1544 are preferably electrically powered. All are electrically connected to a simple control (not shown) to cause them to selectively extend or contract direction, selectively raising and lowering the power rams 1341–1344 in common, and also the (contour) bed 11 that rests upon these rams, under human activation.

A detail perspective view of a preferred power ram 1541–1544 of the fourth embodiment of the modular high-low-adjustable base 15 in accordance with the present invention is shown in FIG. 7. The preferred electric ram assembly is either a type MULTILIFT™ no. 1 or no. 2 available complete with hardware and controller from manufacturer Dewert motorized systems. The electric rams 1511–1514 use a 24 v.d.c. motor (not show) acting through a screw drive (not shown) to develop a maximum (lift) force of 3000 Newtons over a stoke length of up to 350 mm. The speed of movement is 10–20 mm/sec, depending upon load and controls. The installation height is 550 mm. The normal material of construction is extruded aluminum.

The adjustment (lift) range of the preferred system is 300 millimeters (30 centimeters). The lift capacity of the four power rams 1541–1544, collectively, is twelve thousand Newtons, or over one thousand pounds (1000 lbs.). Additional power rams may employed for even greater lift capacity on special order, and configuration, of the high-low base 15.

Figure 8:
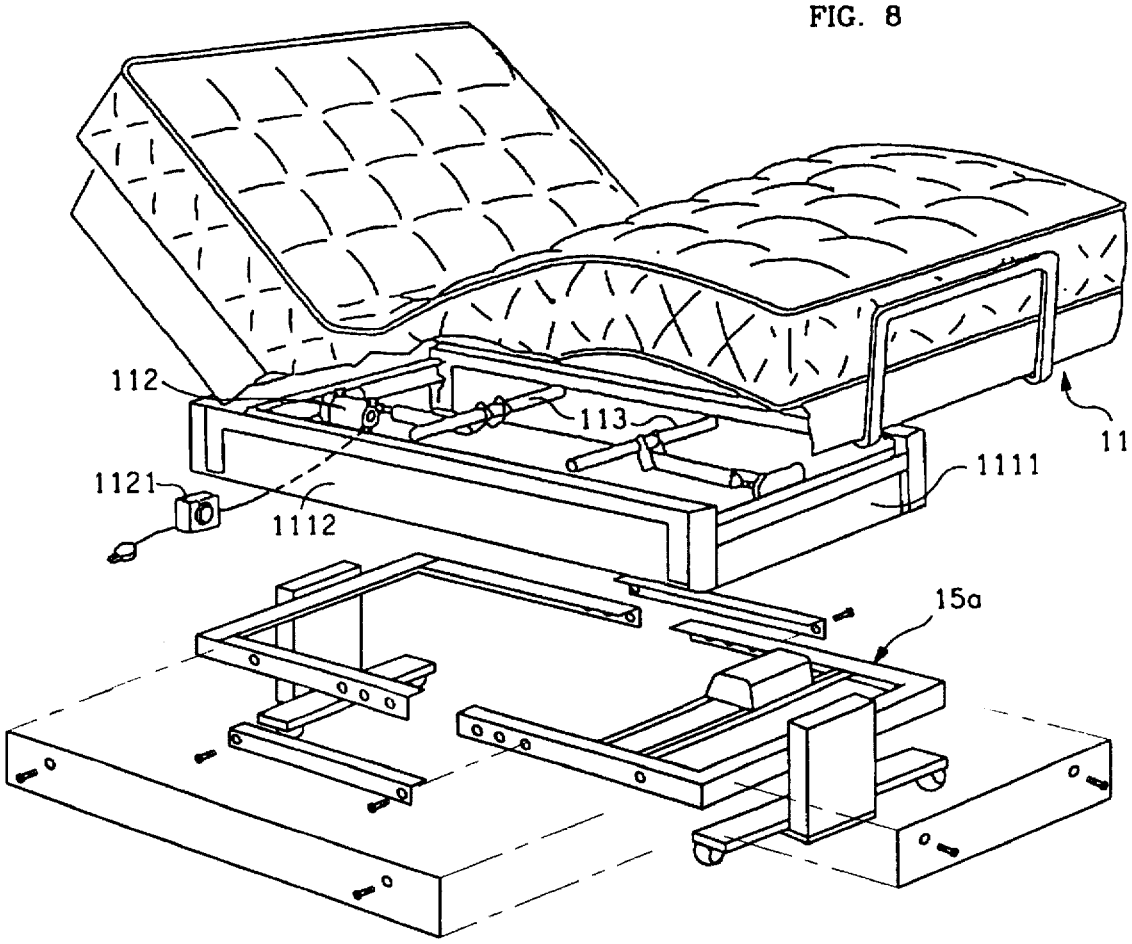
FIG. 8 is an exploded diagrammatic perspective view of a variant of the fourth preferred embodiment of the modular high-low-adjustable base in accordance with the present invention in previously seen in FIG. 6; this variant fourth embodiment of the high-low base being raised and lowered by two, instead of four, extension members.

A variant of the fourth embodiment of a modular high-low-adjustable base 15 in accordance with the present invention is shown in exploded diagrammatic perspective view in FIG. 8. The illustrated high low base **15*a* differs from the high low base 15 of FIG. 8 by employing only two power rams 1541–1542, as opposed to the four power rams 1541–1544** of the original variant.

Considering all Figures, the entire high-low base in its combination of lift mechanism and motive force means always, and notably, fits completely within a void in the volume under the contour bed 11. This capability of all embodiments of the present invention to compactly co-house separate power mechanisms inside a same volume that is substantially defined by the outer frame of the entire bed is an important feature of the invention. By such feature the present invention not only realizes such high-low adjustability, and such contour adjustability, as have previously been characteristic only of "hospital" type beds, but so realizes all such adjustability in a compact, aesthetically pleasing, package well suited for the bedrooms of finer homes and hotels.

Also, and of further note, substantially all the motorized, hydraulic and mechanical components of high-low bases 12–15, and of any (contour) bed 11 that these bases serve to carry and to elevate, are substantially continuously visually obscured during use. The entire combination high-low-adjustable contour-adjustable bed with its high-low base is exceptionally "clean" underneath the bed (such as promotes cleaning). Nothing is prone to snag any bed linens used upon the bed. The entire bed can be made in appearance to mimic a bed that has neither high-low capability, nor contour adjustment capability, nor either such capability. When the bed is set to its lowered position with a straight mattress, it may usually be adapted to very exactly mimic any finer standard bed, and may thus suitably be used as one of two beds in a finer, custom, decorated bedroom where one sleeper or invalid only requires the special capabilities of a high-low adjustable, and/or a contour adjustable, bed.

In accordance with the preceding explanation, variations and adaptations of a modular high-low base for a high-low-adjustable contour-adjustable bed in accordance with the present invention will suggest themselves to a practitioner of the mechanical design arts. In accordance with multitudinous possible variations and adaptations of the present invention, the scope of the invention should be determined in accordance with the following claims, only, and not solely in accordance with those particular embodiments within which the invention has been taught.

What is claimed is:

1. A high-low base for use in raising and lowering an existing contour bed in elevation above a floor, the contour bed having a contour-adjustable upper surface upon which is supported a mattress, a box frame open to the bottom, the box frame and the upper surface and the floor defining in combination a volume, and a contouring mechanism, and a contour mechanism motive means for powering the contouring mechanism to adjust the upper surface in contour, that are located within only a portion of the volume, a remainder of the volume being a void, the high-low base comprising:

a high-low frame, insubstantially larger in area than is the box frame of the contour bed, on which suitably fits and rests the box frame of the contour bed so that the contour bed is carried upon the high-low frame; and an elevation means, fitting within the void, for variably elevating the high-low frame, and the contour bed resting upon the frame, in height above the floor, the elevation means being capable of positioning the high-low frame so that the bottom of the box frame of the contour bed carried upon the high-low frame is substantially at a level of the floor;

wherein because the high-low frame is insubstantially larger in area that is the box frame of the contour bed, because the elevation means fits within the void, and because the elevation means is capable of positioning the high-low frame so that the carried contour bed is upon the floor, the entire high-low base is both insubstantially larger in area than, and is substantially fitted within, the box frame of the contour bed, and the contour bed, that it serves to variably elevate.

2. The high-low base according to claim 1 wherein the high-low frame comprises:

a lower frame member supported upon the floor; and an upper frame member on which suitably fits and rests the box frame of the contour bed;

wherein the elevation means serves to variably elevate the upper frame member in height above the lower frame member and above the floor upon which the lower frame member is supported.

3. The high-low base according to claim 1 wherein the high-low frame simply stably supports, and does not mechanically affix the box frame of the contour bed.

4. The high-low base according to claim 1 wherein the high-low frame is adjustable in height independently that the contour-adjustable upper surface of the contour bed is adjustable in contour.

5. The high-low base according to claim 1 further comprising:

a surround skirt of horizontal dimensions sufficient so as to fit circumferentially about the high-low frame, and of a vertical dimension sufficient so as to essentially bridge a vertical gap between the contour-adjustable upper surface of the contour bed and the floor when the high-low frame is in a full down position.

wherein the surround skirt serves to surround the high-low base, and to enclose it from view, when the high-low base is in its full down position.

6. The high-low base according to claim 1 wherein the high-low frame comprises:

a lower frame member supported upon the floor; and an upper frame member on which suitably fits and rests the box frame of the contour bed; and wherein the elevation means comprises:

a motorized drive mechanism connecting between the lower frame member and the upper frame member in the volume between them for variably elevating the upper frame member in height above the lower frame member; and an idler arm for maintaining the lower frame member and the upper frame member in positional alignment.

7. The high-low base according to claim 1 wherein the elevation means comprises:

a plurality of vertically-oriented hydraulic cylinders affixed to the high-low frame so that they contact the floor; and selectively activated hydraulic means for forcibly extending and retracting the plurality of hydraulic cylinders so that the high-frame, and the contour bed that is carried upon the high-low frame, is raised and lowered in elevation above the floor.

8. The high-low base according to claim 7 wherein the high-low frame comprises:

a hollow corner post at each of the four corners of a rectangle, in each of which corner posts is positioned a one of the plurality of hydraulic cylinders;

two frame rails extending at a right angles relative to each other from each corner post so as to each mechanically joint to a correspondingly-extending frame rail of an adjacent corner post; and means for variably adjusting the mechanical joining of the frame rails of the corner posts so as to circumscribe a variable rectangular area in which suitably fits and rests a rectangular contour bed of variably predetermined size.

9. The high-low base according to claim 8 wherein the means for variably adjusting the mechanical joining comprises:

a strut bridging between an extending frame rail of a one corner post and a correspondingly-extending frame rail of an adjacent corner post;

wherein the lengths of the frame rails necessary to circumscribe the rectangular area of variable size may be lessened to the extent of a contribution of a length of the strut.

10. The high-low base according to claim 7 wherein each of the plurality of vertically-oriented hydraulic cylinders comprise:

a plunger disposed in a downwards direction so as to contact the floor at its tip region.

11. The high-low base according to claim 7 wherein the selectively activated hydraulic means comprises:

a hydraulic pump rotatable to provide hydraulic force to the plurality of hydraulic cylinders for their selective extension and retraction;

an electric motor for rotating the hydraulic pump; and an electrical control panel for selectively under manual control applying electric power to the electric motor.

12. The high-low base according to claim 1 wherein the high-low frame comprises:

a plurality of rails circumscribing an area in which suitably fits and rests the contour bed so that the contour bed is carried upon the plurality of rails; and wherein the elevation means comprises:

a plurality of vertically-oriented hydraulic cylinders affixed to the plurality of rails so that they contact the floor;

selectively activated hydraulic means, of complimentary size and shape so as to fit within the void, for forcibly extending and retracting the plurality of hydraulic cylinders so that the plurality of rails, and the contour bed that is carried upon the plurality of rails of the frame, is raised and lowered in elevation above the floor.

13. The high-low base according to claim 1 wherein the high-low frame comprises:

a lower member (i) fitting completely within a volume and an area of the box frame of the contour adjustable bed while (ii) resting on the floor, the lower member subtending sufficient area while so resting so as to form a stable base;

an upper member attaching to the underside of the box frame of the contour adjustable bed within the volume and within the area of this box frame; and and wherein the elevation means comprises:

a plurality of linkage arms pivoting relative to each of the upper member and the lower member and connecting therebetween so as to, upon forcibly assuming different positions, locate the upper member and the lower member to different distances of separation one to the other;

a cable for transmitting force to plurality of linkage arms; and a motor for providing the force transmitted through the cables to the linkage arms in order to, by locating the upper member and the lower member to different distances of separation one to the other, raise and lower the contour-adjustable bed;

wherein each and all of the lower member, the upper member, and the elevation means fit within the volume and within the area of the box frame of the contour-adjustable bed.

14. The high-low base according to claim 13 wherein the elevation means further comprises:

an idler arm for maintaining the lower member and the upper member in positional alignment.

15. The high-low base according to claim 1 wherein the high-low frame comprises:

four upper members each of which fits to a respective corner of the box frame of the contour-adjustable bed so as to insubstantially increase a volume and an area of the box frame, the four members essentially being within the volume and within the area of the box frame;

a first plurality of lower members disposed on the floor under the four upper members substantially in a shadow of the box frame; and wherein the elevation means comprises:

a second plurality of elongate extension means, connecting between the first plurality of lower members and the four upper members within the volume and within the area between them, for variably controllably extending in length so as to locate the four upper members at different distances of separation from the plurality of lower members thereby to raise and to lower the contour-adjustable bed having the box frame that is attached to the four upper members;

wherein because the four upper members insubstantially increase the volume and the area of the box frame, because the first plurality of lower members are substantially in the shadow of the box frame, and because the second plurality of elongate elevation means connect between the first plurality of lower members and the four upper members, the entire high-low base is insubstantially larger in area than the contour-adjustable bed that it serves to lift.

16. The high-low base according to claim 15 wherein the first plurality of lower members comprises:

two bases disposed on the floor each positioned symmetrically under a pair of the four upper members as are located at a head and at a foot of the box frame of the contour-adjustable bed.

17. The high-low base according to claim 15 wherein the second plurality of elongate elevation means comprises:

two extendible rams, each connecting between a one of the two bases and two of the four upper members, for forcing the two bases to various distances of separation from the four upper members.

18. The high-low base according to claim 15 wherein the first plurality of lower members comprises:

four bases disposed on the floor each under a corresponding one of the four upper members.

19. The high-low base according to claim 18 wherein the second plurality of elongate elevation means comprises:

four extendible rams, each connecting between a one of the four bases and a corresponding one of the four upper members, for forcing the four bases to various distances of separation from the four upper members; and four cylinders each connecting between a one of the two bases and two of the four upper members.

20. A high-low base retroffitable to and susceptible of integration with a contour-adjustable bed having a peripheral space frame to the end of raising and lowering the contour-adjustable bed in elevation above a floor, the high-low base comprising:

a lower member (i) fitting completely within a volume and an area of the peripheral space frame of the contour adjustable bed while (ii) resting on the floor, the lower member subtending sufficient area while so resting so as to form a stable base;

an upper member attaching to the underside of the peripheral space frame of the contour adjustable bed within the volume and within the area of this peripheral space frame;

a plurality of linkage arms pivoting relative to each of the upper member and the lower member and connecting therebetween so as to, upon forcibly assuming different positions, locate the upper member and the lower member to different distances of separation one to the other, a cable for transmitting force to plurality of linkage arms, and a motor for providing the force transmitted through the cables to the linkage arms in order to, by locating the upper member and the lower member to different distances of separation one to the other, raise and lower the contour-adjustable bed;

wherein each and all of the lower member, the upper member, and the elevation means fit within the volume and within the area of the peripheral space frame of the contour-adjustable bed.

21. The high-low base according to claim 20 wherein the elevation means further comprises:

an idler arm for maintaining the lower member and the upper member in positional alignment.

22. A high-low base retroffitable to and susceptible of integration with a contour-adjustable bed having a rectangular peripheral space frame to the end of raising and lowering the contour-adjustable bed in elevation above a floor, the high-low base comprising:

four upper members each of which fits to a respective corner of the rectangular peripheral space frame of the contour-adjustable bed so as to insubstantially increase a volume and an area of this peripheral space frame, the four members essentially being within the volume and within the area of the peripheral space frame;

a first plurality of lower members disposed on the floor under the four upper members substantially in a shadow of the peripheral space frame; and a second plurality of elongate elevation means, connecting between the first plurality of lower members and the four upper members within the volume and within the area between them, for variably controllably extending in length so as to locate the four upper members at different distances of separation from the plurality of lower members thereby to raise and to lower the contour-adjustable bed having the peripheral space frame that is attached to the four upper members;

wherein because the four upper members insubstantially increase the volume and the area of the peripheral space frame, because the first plurality of lower members are substantially in the shadow of the space frame, and because the second plurality of elongate elevation means connect between the first plurality of lower members and the four upper members, the entire high-low base is insubstantially larger in area upon the floor than the contour-adjustable bed that it serves to lift.

23. The high-low base according to claim 22 wherein the first plurality of lower members comprises:

two bases disposed on the floor each positioned symmetrically under a pair of the four upper members as are located at a head and at a foot of the peripheral space frame of the contour-adjustable bed.

24. The high-low base according to claim 23 wherein the second plurality of elongate elevation means comprises:

two extendible rams, each connecting between a one of the two bases and two of the four upper members, for forcing the two bases to various distances of separation from the four upper members.

25. The high-low base according to claim 22 wherein the first plurality of lower members comprises:

four bases disposed on the floor each under a corresponding one of the four upper members.

26. The high-low base according to claim 25 wherein the second plurality of elongate elevation means comprises:

four extendible rams, each connecting between a one of the four bases and a corresponding one of the four upper members, for forcing the four bases to various distances of separation from the four upper members.

four cylinders each connecting between a one of the two bases and two of the four upper members.

* * * * *